US005239715A

United States Patent [19]

Wagner

[11] Patent Number: 5,239,715

[45] Date of Patent: Aug. 31, 1993

[54] BORDER STABILIZING AND REINFORCING MEMBER FOR USE IN MATTRESSES, CUSHIONS AND THE LIKE

[75] Inventor: Robert F. Wagner, Medina, Ohio

[73] Assignee: The Ohio Mattress Company Licensing and Components Group, Cleveland, Ohio

[21] Appl. No.: 833,683

[22] Filed: Feb. 11, 1992

[51] Int. Cl.[5] ..... A47C 27/04

[52] U.S. Cl. ..... 5/475; 5/474; 5/481

[58] Field of Search ..... 5/474–481, 5/464

[56] References Cited

U.S. PATENT DOCUMENTS

| | | | |
|---|---|---|---|
| 1,865,043 | 6/1932 | Pittoni | 5/474 |
| 2,408,382 | 10/1946 | Dubick . | |
| 2,826,769 | 3/1958 | Drews | 5/474 |
| 2,940,089 | 6/1960 | Koenigsberg . | |
| 3,251,078 | 5/1966 | Calla | 5/477 |
| 3,262,135 | 7/1966 | Fasanella . | |
| 3,517,398 | 6/1970 | Patton | 5/464 |
| 3,618,146 | 11/1971 | Ferdinand . | |
| 3,822,426 | 7/1974 | Mistarz . | |
| 3,848,283 | 11/1974 | Ikeda . | |
| 4,067,076 | 1/1978 | Krier . | |
| 4,677,701 | 7/1987 | Galumbeck | 5/464 |
| 4,907,309 | 3/1990 | Breckle | 5/480 |
| 5,048,167 | 9/1991 | Heffley | 5/475 |
| 5,113,539 | 5/1992 | Strell | 5/475 |

*Primary Examiner*—Peter M. Cuomo
*Assistant Examiner*—Flemming Saether
*Attorney, Agent, or Firm*—Willian Brinks Olds Hofer Gilson & Lione

[57] ABSTRACT

A rhomboid-shaped member of resilient material for use in the innerspring of a mattress, cushion or the like, is inserted between adjacent springs rows with its major cross sectional axis extending perpendicular to the support surface. When placed as a beam between springs defining the innerspring perimeter and interior springs adjacent thereto, this arrangement results in an assembly with a border of greater firmness, without a significantly harsh transition between compression of the border area and the innerspring interior area.

17 Claims, 2 Drawing Sheets

BORDER STABILIZING AND REINFORCING MEMBER FOR USE IN MATTRESSES, CUSHIONS AND THE LIKE

FIELD OF THE INVENTION

This invention relates to stabilizers and reinforcers for innersprings, such as spring mattresses, cushions and the like, and a method of making innerspring assemblies using the same.

BACKGROUND OF THE INVENTION

Innerspring assemblies for mattresses or cushions are generally composed of a plurality of spring coils arranged side-by-side in parallel rows, with parallel columns also formed orthogonal to the rows. Border wires usually encircle both the upper and lower perimeters of the support surface formed by the innerspring, such as in a mattress, and connect to terminal convolutions of the perimetrical springs by way of small diameter helical springs which wrap around the border wire.

The terminal convolutions of the coil springs are typically formed with an enlarged diameter compared to the spirals or turns, that are axially inward from the coil ends. This allows for interengagement of the spring terminal ends, as along rows and/or columns, and stabilizes the spring under compression. It is a common practice to overlap the terminal convolutions of adjacent spring coils in a row, and then wind even smaller diameter helical spring coils, referred to as cross-helicals, across the rows to encircle the overlapped terminal convolution portions.

With respect to innerspring edges, i.e., the side of the unit, there are some general considerations of manufacture and comfort that underlie their design. In the normal use of an innerspring, the edges are subjected to greater compression forces than the interior of the innerspring, since people sit on the edge of the innerspring when sitting or rising. The added stresses and strains on the sides can result in greater wear that is manifested in a tipping or side-sway about the border thereof. This type of wear may reduce the comfort of the item, and can result in unevenness of the side. The innerspring can further give the impression of a degree of softness it does not have, since a person sitting on the edge provides a much more concentrated load on the underlying springs than a prone individual lying upon the innerspring.

It has thus been found desirable to reinforce and provide greater stability to the edges of an innerspring assembly. For instance some, as in U.S. Pat. No. 3,262,135, have provided a resilient foam material border member perimetrically surrounding the innerspring that freely and independently supports loads apart from the innerspring. Others, as in U.S. Pat. No. 2,826,769, have devised a structure and method of adding resilient foam material about the perimetrical innerspring edge and affixed to the border strip material. Compression of this structure may create slack in the border allowing such edge arrangements to potentially disengage from respective coils, thereby reducing the effect advantages of the original structure.

Other efforts have also been directed, as shown in U.S. Pat. No. 3,618,146, to a border stabilizer formed from a plurality of foam strips positioned along the perimetrical row of spring coils of an innerspring. Each strip is slit to fit over one or more convolutions of the outermost coils. Another similar design depicted in U.S. Pat. No. 3,822,426, has a combined mattress topper pad and border stabilizer with one or more slits provided in the stabilizer portion to fit the generally rectangular cross-sectioned stabilizer onto the springs.

A method of stabilizing and reinforcing a spring border is also shown in U.S. Ser. No. 07/633,408, filed Dec. 21, 1990, wherein a continuous length of resilient foam rope is wedged between convolutions of adjacent springs a plurality of turns about the perimeter of the coil spring assembly.

SUMMARY OF THE INVENTION

It is a principal objective of the present invention to provide an improved stabilizing member of resilient material for an innerspring assembly, and method of making an innerspring using this member, wherein the stabilizing member can be placed internally in the innerspring, i.e., it is not restricted to placement along the outboard edge of the unit, and is configured to be easily inserted between adjacent rows of spring coils. It is a further objective to provide such a stabilizing member with a unique cross-sectional shape which allows some control over the firmness and spring characteristics of the member.

To these and other ends, the present invention comprises an innerspring assembly of a plurality of springs defining a support surface with at least a first row of spring elements, and a second row of springs spaced inboard thereto and generally parallel to the first row of springs. A gap is formed between the first and second spring rows. The springs making up the support surface are retained in position by conventional means, as by cross-helical interconnection.

At least one elongated stabilizing member of resilient material, having a longitudinal axis and a cross-section with major and minor axes, is located between the first and second spring rows in the gap therebetween, as by sliding the resilient member along its longitudinal axis into the gap. The major axis of the resilient member extends substantially perpendicular to the support surface.

In a preferred embodiment, an innerspring assembly for cushions, mattresses and the like, may readily be stabilized simply and efficiently by providing an elongated resilient foamaceous member having a rhomboid-shaped cross-section with the aforementioned major and minor axes. The springs are organized into orthogonal rows. The resilient member, provided in four or more separate pieces for a mattress innerspring, for example, is inserted between the outermost (or perimetrical) row of springs and the next adjacent inboard row, with the major axis of the member extending perpendicular to the support surface. The border of a mattress, for example, is thereby stabilized without modification to a typical innerspring assembly, and without any slits or other means required in the foam member to affix the member in the innerspring.

The resulting construction improves the compression resistance about the perimeter of the spring unit, and reduces sagging. There is also no interference with the edge appearance of the unit because the member is located interior of the perimetrical coils.

Additionally, the border stabilizing member spring rate may be matched with, or otherwise related to, that of the surrounding springs to reduce any noticeable transition variations between compression of the border area and then the interior area of the innerspring, or to otherwise modify the edge firmness. The border stabilizing member firmness can also be varied by selecting the compression characteristics of the foamed material itself, by altering the internal geometry of the member, or some combination of the two.

In a disclosed embodiment, the major axis of the rhombus-shaped cross-section is nearly three times that of the minor axis, yielding a thin-width but tall cross-section. This shape has been found to yield a variable rate of firmness. The shape also facilitates insertion of the resilient members between spring rows.

The foregoing features and advantages of this invention will be further understood upon consideration of the following detailed description of presently preferred embodiments of the invention taken in conjunction with the accompanying drawings, in which:

DETAILED DESCRIPTION OF PRESENTLY PREFERRED EMBODIMENTS OF THE INVENTION

The present invention is hereafter described in its application in an innerspring assembly for a mattress. It will of course be understood that, while it is described in this particular environment, the border stabilizing member and method of making an innerspring using the same is considered to have utility in other products utilizing an innerspring assembly, such as seats and cushions.

Figure 1:
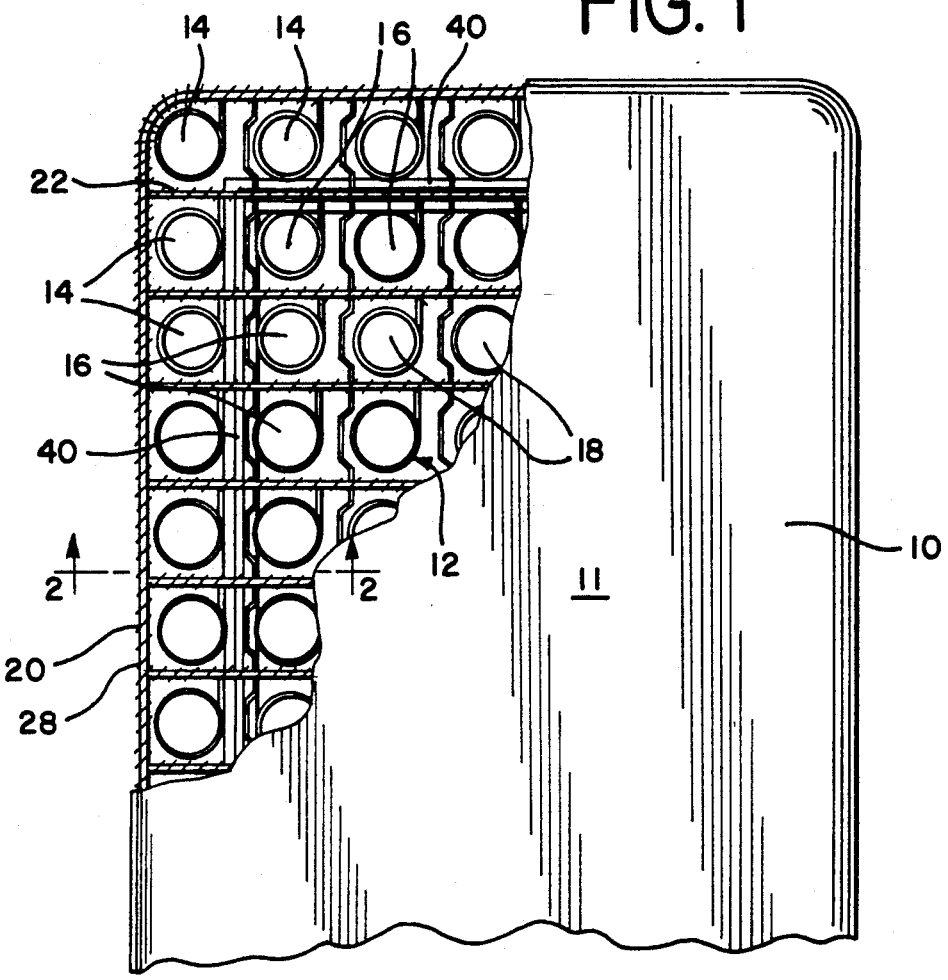
FIG. 1 is a plan view of a mattress innerspring made in accordance with the teachings of this invention.

Referring to the drawings, in FIG. 1 mattress 10 has an innerspring unit or assembly 12 comprised of perimetrical springs 14, adjacent springs 16, and interior springs 18 arranged in a rectangular pattern of parallel rows and orthogonal columns (hereafter, both being referred to as "rows" regardless of the direction they run). Although only a portion of the figure is broken out to expose the innerspring assembly, it is to be understood that these rows extend across the length and width of innerspring assembly 12.

Border wires 28 extend around the perimeter of innerspring assembly 12 on the tope and bottom surfaces. Border wire helical spring 20 attaches the terminal convolutions of perimetrical springs 14 to border wire 18. Cross-helical springs 22, extending across the innerspring assembly 12, attach to terminal ends of adjacent adjoining perimetrical springs 14, adjacent springs 16 and/or interior springs 18, as is readily noted in FIG. 1. The cross-helicals 22 could also extend lengthwise, if so desired.

Figure 2:
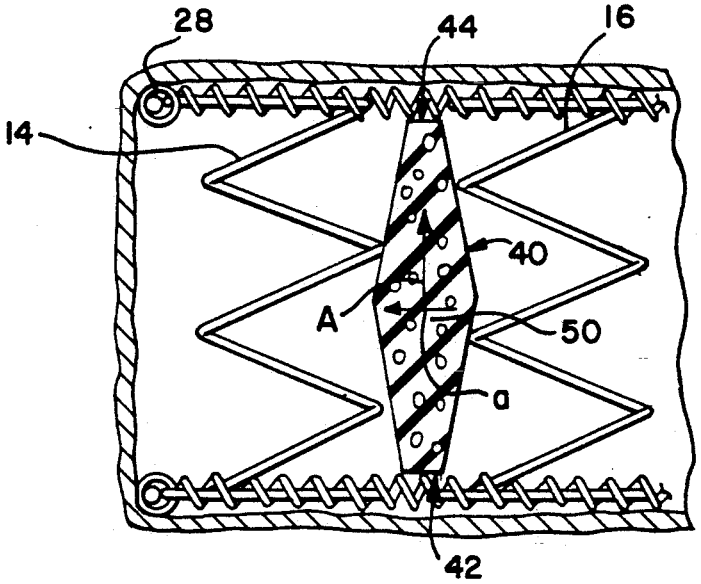
FIG. 2 is a cross-sectional view taken along line 2—2 of FIG. 1.

Referring to FIG. 2, all of the springs 14, 16, 18 are identical. The springs have larger diameter convolutions at the terminal ends thereof, and smaller diameter convolutions or turns, in between. A gap is thereby provided between joined springs; a gap is as well provided between rows of adjacent springs which do not have their terminal convolutions so joined.

Located within the gap between coils 14 and 16 is resilient stabilizing beam member 40. The member 40 is elongated, with a generally rhombus-shaped or diamond-shaped exterior, having a longitudinal axis and a cross-section with a major axis A as measured along the diagonal between where two diametrically opposed corners would be with the side surfaces of the rhombus-shape being fully extended to terminate at a point and a minor axis a as measured along the diagonal between where the other two diametrically opposed corners are, or would be, as defined by the intersection of the side surfaces of the rhombus-shape. In this embodiment of FIG. 2, member 40 is substantially solid and composed of a generally uniform resilient foamed material. The major axis A of member 40 is oriented substantially parallel to the longitudinal axes of the surrounding coils 14 and 16 i.e., perpendicular to the support surface, and the minor axis a extends generally perpendicular to the longitudinal axes of the springs. The exterior of member 40 is dimensioned to preferably contact the spring sides in its uncompressed state. Although the ends of the member along major axis A may terminate at a point, it is preferable to truncate the ends with parallel planar sides 42, 44. The height (major axis A) of the resilient member 40 is slightly less than the height of the springs.

Member 40 may readily be placed in the previously described orientation within the bare innerspring 12 (i.e., prior to build-up or upholstery) in the following manner. A resilient foam member 40 is generally in one piece. A plurality of such pieces, or segments, may be employed together. For a mattress innerspring, such segments would be inserted first at one end of the unit, then along the sides, then along the opposite end, in the long gaps defined between the rows of springs 14 and 16. 33 inch and 24 inch long segments have been found advantageous. For example, along the side of a full-size mattress a first 33 inch segment of the resilient foam member 40 is inserted along a path parallel to a side of innerspring 12 between perimetrical coils 14 and adjacent coils 16 for its full length. Another 33 inch segment is then abutted to the first segment, and inserted advancing the previously inserted piece along the gap. The two segments thereby extend along substantially the entire lateral side of the innerspring 12. The other side and ends of the unit are reinforced in the same manner (although a single 33 inch segment may be sufficient for some ends). Upon completion of the inserting operation, the unit may be finished with ticking, padding and covering material, generally indicated as 11 in FIG. 1.

It can be readily appreciated by those skilled in the art that the firmness characteristics of the border created by this assembly can be varied by the compression characteristics of the resilient foam material, and the internal geometry of the beam member. For example, a rhombus-shaped hollow interior 50, 50' centered on the member's centroid, as in FIGS. 3 and 4, may be utilized to create borders of lesser firmness. By varying the density and rigidity of the foam, the degree to which the foam resists compression can also be adjusted as desired. For purposes of the present invention, any durable elastically compressible foam, such as polyurethane foam, polyethylene foam, foam rubber, or latex foam, with a suitable density characteristic may be employed, and it is advantageous that this material have a tensile strength which resists tearing. A high density polyethylene foam with a density of approximately 2.0 lbs./cu. ft. minimum has been found useful in the FIG. 2 embodiment. Moreover, it can also be readily appreciated that an interior hollow (50, 50') within the member may be filled with a resilient material of a density greater or lesser than the material comprising the exterior of the beam, thereby creating a member with dual density properties.

It can also be readily appreciated that the spring rate of the member 40 may be altered by changing the exterior geometry thereof. For example, while it has been determined that a rhombus-shaped exterior with truncated major axis ends is preferred in "matching" spring rates with existing innerspring coils, other but similar shapes may be useful. The preferred configuration has the additional benefit of firming substantially the full lengths of surrounding coils, because prior border stabilizers generally firmed the interior of perimetrical coils, thus requiring compression of at least a full convolution before realizing a firming effect from the stabilizer.

By way of specific example, member 40 composed of high density polyethylene foam of approximately 2.0 lbs./cu. ft. minimum density has a major axis A dimension terminating at truncated points 42, 44 of $4\frac{3}{4}$ in. and minor axis a dimension of $1\frac{5}{8}$ in. The truncated portions 42, 44 have a width of $\frac{1}{2}$ in. The cross-sectional area is approximately 5.05 sq. in. The member 40 is thus tall and thin, having a minor axis about $\frac{1}{3}$ of the major axis, in keeping with the thin-width of the spring gaps within which it is to be inserted, and the desirable firmness to be achieved.

Figure 3:
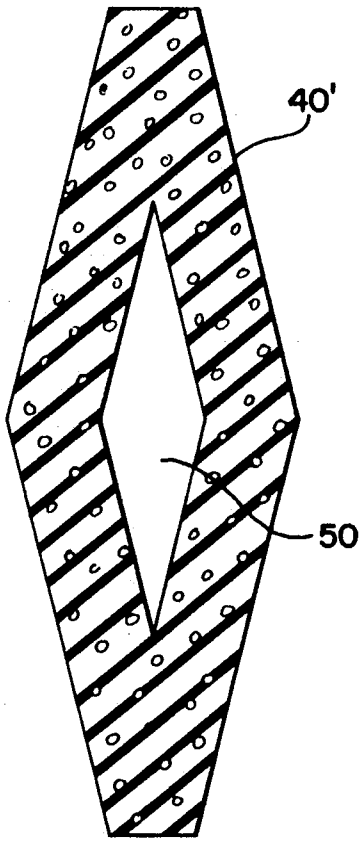
FIG. 3 is a cross-sectional view through a member similar to that of FIG. 2 of another embodiment.

The FIG. 3 embodiment, member 40', has a rhomboid-shaped hollow interior 50, and a major axis A dimension of $4\frac{3}{4}$ in., and a minor axis a dimension of $1\frac{5}{8}$ in. The truncated portions have a length of $\frac{1}{2}$ in. Rhomboid-shaped hollow interior 50, centered on the centroid of member 40', has a dimension along major axis A of $2\frac{1}{2}$ in. and a dimension along minor axis a of $\frac{5}{8}$ in. This resulting cross-sectional area is approximately 4.29 sq. in.

Figure 4:
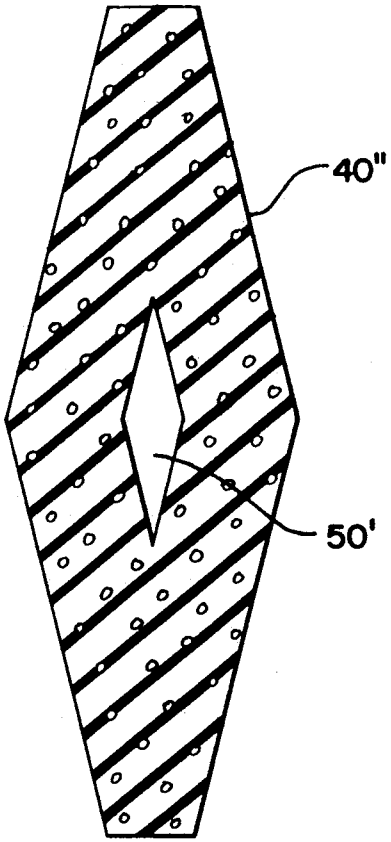
FIG. 4 is a cross-sectional view similar to that of FIG. 3 of yet another embodiment.

The FIG. 4 embodiment, member 40'', also has a rhomboid-shaped hollow interior 50', with major and minor axes as in the FIG. 3 embodiment. Rhomboid-shaped hollow interior 50', centered on the centroid of member 40'', has a dimension of 1 7/16 in. along the major axis and a dimension of 5/16 in. along the minor axis, resulting in a cross-sectional area of approximately 4.8 sq. in.

As to the method of placement of member 40 within innerspring 12, it can be readily appreciated that a member 40 may be run other than between perimetrical coils 14 and coils 16 of innerspring 12. The member 40 may be placed only along certain sides, if so desired, or even further interior to the innerspring. Multiple segments may be placed between rows of coils, as described, but further could be of differing firmness characteristics corresponding to the use that the affected row sector may have. The segments may be cut normal to the length of the beam, or cut supplementary or complementary.

Thus, while the invention has been described with reference to a particular embodiment, further applications and modifications of the invention will be apparent to others. The foregoing description of the preferred embodiments of the present invention has been presented for purposes of illustration and description, and is not intended to be exhaustive or to limit the invention to the precise form disclosed. Modifications and variations are possible in light of the above teachings, yet still fall within the scope of the claims hereafter. It is intended that the scope of the invention be defined by the following claims, including all equivalents.

What is claimed is:

1. An interspring assembly comprising:

a plurality of springs having longitudinal axes organized into rows with at least a first row of springs, and a second row of springs spaced inboard to said first row and generally parallel ot said first row, a gap being formed between said first and second rows;

means for retaining said springs in said assembly; and an elongated stabilizing member of resilient material, said stabilizing member having a longitudinal axis where side surfaces define a rhombus-shaped cross-section with a major axis as measured along the diagonal between where two diametrically opposed corners would be with the side surfaces of the rhombus-shape being fully extended to terminate at a point, and a minor axis as measured along the diagonal between where the other two diamet rically opposed corners would be with the side surfaces of the rhombus-shape being fully extended to terminate at a point, wherein the major axis is longer than the minor axis, said stabilizing member being located between said first and second rows of springs in said gap with said major axis thereof aligned substantially parallel to said longitudinal axes of said springs and said minor axis extending generally perpendicular to said longitudinal axes of said springs.

2. An innerspring assembly comprising:

a plurality of springs having longitudinal axes organized into rows with at least a first row of springs adjacent to and extending around a perimeter to the innerspring and a second row of springs spaced inboard to said first row and generally parallel to said first row, a gap being formed between the first and second rows;

means for retaining said springs in said assembly; and an elongated stabilizing member of resilient material, said stabilizing member having a longitudinal axis where side surfaces define a rhombus-shaped cross-section with a major axis as measured along the diagonal between where two diametrically opposed corners would be with the side surfaces of the rhombus-shape being fully extended to terminate at a point and a minor axis as measured along the diagonal between where the other two diametrically opposed corners would be with the side surfaces of the rhombus-shape being fully extended to terminate at a point, wherein the major axis is longer than the minor axis, said stabilizing member being located between said first and second rows of springs in said gap with said major axis thereof aligned substantially parallel to said longitudinal axes of said springs.

3. A mattress innerspring assembly comprising:

a plurality of springs defining a support area having a top surface, a bottom surface and sides;

means for retaining said springs in said support area;

said springs organized into at least one perimetrical row around said support area and a second row spaced inboard thereto defining a space between said perimetrical and second row;

an elongated border stabilizing member of resilient foamed material nested between said perimetrical and second rows in said space, said border stabilizing member having a longitudinal axis where side surfaces define a rhombus-shaped cross-section with a major axis as measured along the diagonal between where two diametrically opposed corners would be with the side surfaces of the rhombus-shape being fully extended to terminate at a point and a minor axis as measured along the diagonal between where the other two diametrically opposed corners would be with the side surfaces of the rhombus-shape being fully extended to terminate at a point, wherein the major axis is longer than the minor axis extending generally perpendicular to said top and bottom surfaces.

4. The mattress innerspring assembly of claim 3, wherein said springs define a rectangular support area of orthogonal rows of springs, and said border stabilizing member has a rhomboid shape and is nested between said perimetrical and second rows in said space along all sides of said innerspring assembly.

5. An elongated stabilizing beam of resilient material for use in an innerspring assembly formed of springs, with said springs defining at least a first row and a second row, said second row being spaced from said first row and defining a gap therebetween, said stabilizing beam being insertable within said gap where side surfaces define a rhombus-shaped cross-section with a major axis as measured along the diagonal between where two diametrically opposed corners would be with thc side surfaces of the rhombus-shape being fully extended to terminate at a point and a minor axis as measured along the diagonal between where the other two diametrically opposed corners would be with the side surfaces of the rhombus-shape being fully extended to terminate at a point, wherein the major axis is longer than the minor axis and said major axis of said stabilizing beam extending perpendicular to an upper surface of said innerspring assembly.

6. A method of stabilizing and reinforcing an innerspring assembly for cushions and mattresses, comprising the steps of:

providing elongated resilient members each having, side surfaces defining a rhombus-shaped cross-section with a major axis as measured along the diagonal between where two diametrically opposed corners would be with the side surfaces of the rhombus-shape being fully extended to terminate at a point and a minor axis as measured along the diagonal between where the other two diametrically opposed corners would be with the side surfaces of the rhombus-shape being fully extended to terminate at a point, wherein the major axis is longer than the minor axis forming an innerspring of a plurality of springs defining a support surface and sides, said springs being organized into a first row and a second row spaced inwardly from said first row and running generally parallel to said first row, said second row being spaced from said first row with a gap thereby being defined between said first and second rows; and inserting said resilient member between said first and second rows within said gap by sliding therein in a direction parallel to said support surface with said resilient member major axis extending generally perpendicular to said support surface of the innerspring assembly.

7. The method of claim 6 wherein said springs of said innerspring are joined together before inserting said resilient member, and said resilient member is inserted in said gap by sliding therein in a direction parallel to said support surface.

8. The method of claim 6 wherein said innerspring assembly is formed of orthogonal rows and columns of springs, and including the step of inserting said stabilizing members spaced inboard from and substantially parallel to each said side.

9. The method of claim 8 wherein said first row of springs is the outermost and perimetrical row of springs of said innerspring.

10. An innerspring assembly comprising:

a plurality of spring elements defining a support surface, with at least a first row of spring elements and a second row of spring elements spaced inboard to said first row and generally parallel to said first row, a gap being formed between said first and second rows;

means for retaining said spring elements in said innerspring assembly; and at least one elongated stabilizing member of resilient material, said stabilizing member having a longitudinal axis where side surfaces define a rhombus-shaped cross-section with a major axis as measured along the diagonal between where two diametrically opposed corners would be with the side surfaces of the rhombus-shape being fully extended to terminate at a point and a minor axis as measured along the diagonal between where the other two diametrically opposed corners would be with the side surfaces of the rhombus-shape being fully extended to terminate at a point, wherein the major axis is longer than the minor axis with said major axis thereof extending substantially perpendicular to said support surface,

11. The innerspring assembly of claim 10 wherein said innerspring assembly has lateral sides, and said stabilizing member is spaced inboard from and substantially parallel to each said side.

12. The innerspring assembly of claim 11 wherein said stabilizing member is comprised of a plurality of abutting segments.

13. The innerspring assembly of claim 11 wherein said innerspring assembly is rectangular, said first row of springs defining a perimetrical row to said innerspring assembly, and said stabilizing member major axis having a length slightly less than a length defined by a common height of each said spring element.

14. The innerspring assembly of claim 10 wherein said minor axis of said stabilizing member is about $\frac{1}{3}$ of said major axis.

15. The innerspring assembly of claim 14 wherein said stabilizing member is formed of a substantially solid piece of foam material having a density of about 2 lbs./cu. ft.

16. The innerspring assembly of claim 10 wherein said minor axis of said stabilizing member is about $\frac{1}{3}$ of said major axis, and said stabilizing member is squared-off at the ends of said major axis.

17. A mattress innerspring comprising:

a plurality of coil springs organized into orthogonal rows and defining a support surface, with a first row of springs forming a perimeter to said innerspring and a second row of springs spaced inboard and adjacent to said first row and generally parallel to said first row, a gap being formed between said first and second rows;

means for retaining said springs in said innerspring; and at least one elongated stabilizing member of resilient foamaceous material having a density of about 2 lbs./cu.ft., said stabilizing member having side surfaces defining a rhombus in cross-sectional shape with a major axis and a minor axis, said minor axis as measured along the diagonal between where two diametrically opposed corners would be with the side surfaces of the rhombus-shape being fully extended to terminate at a point being about $\frac{1}{3}$ of said major axis as measured along the diagonal between where the other two diametrically opposed corners would be with the side surfaces of the rhombus-shape being fully extended to terminate at a point, said major axis having a length about equal to the height of said springs, said stabilizing member being located between said first and second rows of springs in said gap with said major axis thereof extending substantially perpendicular to said support surface, said stabilizing member extending along and parallel to substantially the entire perimeter of said innerspring.

* * * * *

UNITED STATES PATENT AND TRADEMARK OFFICE

CERTIFICATE OF CORRECTION

PATENT NO. : 5,239,715

DATED : August 31, 1993

INVENTOR(S) : Robert F. Wagner

It is certified that error appears in the above-indentified patent and that said Letters Patent is hereby corrected as shown below:

Column 1, line 33, delete "side" and substitute therefor --sides--.
Column 6, claim 1, line 5, delete "ot" and subsitute therefor-- to --.
Column 6, claim 1, line 16, at the end of the line, after "diamet" insert a hyphen--.
Column 7, claim 3, line 7, after "minor axis" insert -- , said major axis--.
Column 7, claim 6, line 36, after "having" delete -- , --.
Column 7, claim 6, line 47 after "minor axis" insert a comma--.
Column 8, claim 10, line 29, delete "," and substitute therefor-- . --.

Signed and Sealed this

Fourteenth Day of February, 1995

Bruce Lehman

*Attest:*

BRUCE LEHMAN

*Attesting Officer*

*Commissioner of Patents and Trademarks*